US010190281B2

(12) United States Patent
Xu

(10) Patent No.: US 10,190,281 B2
(45) Date of Patent: Jan. 29, 2019

(54) SECTIONAL MODULAR LARGE-DEFORMATION-RESISTANT IMPACT-RESISTANT COMPOSITE ROCK BOLT AND ITS ASSEMBLING METHOD

(71) Applicant: Guoan Xu, Xuzhou (CN)

(72) Inventor: Guoan Xu, Xuzhou (CN)

( * ) Notice: Subject to any disclaimer, the term of this patent is extended or adjusted under 35 U.S.C. 154(b) by 0 days.

(21) Appl. No.: 15/524,932

(22) PCT Filed: Jun. 6, 2016

(86) PCT No.: PCT/CN2016/084918

§ 371 (c)(1),
(2) Date: May 5, 2017

(87) PCT Pub. No.: WO2017/190397

PCT Pub. Date: Nov. 9, 2017

(65) Prior Publication Data

US 2018/0202122 A1 Jul. 19, 2018

(30) Foreign Application Priority Data

May 3, 2016 (CN) ..... 2016 1 0286697

(51) Int. Cl.
*E02D 5/80* (2006.01)
*E21D 21/00* (2006.01)
*E21D 20/02* (2006.01)

(52) U.S. Cl.
CPC ..... *E02D 5/808* (2013.01); *E21D 21/00* (2013.01); *E21D 21/008* (2013.01); *E21D 21/0046* (2013.01); *E21D 21/0053* (2016.01); *E21D 20/028* (2013.01); *E21D 21/004* (2013.01)

(58) Field of Classification Search
USPC ..... 405/259.2
See application file for complete search history.

(56) References Cited

U.S. PATENT DOCUMENTS 4,630,971 A * 12/1986 Herbst ..... E21D 21/008 405/259.1
5,984,588 A * 11/1999 Ferrari ..... E21D 21/008 405/259.5
9,657,453 B1 * 5/2017 Shin ..... E02D 5/765

* cited by examiner

*Primary Examiner* — Kyle Armstrong
(74) *Attorney, Agent, or Firm* — Treasure IP Group, LLC

(57) ABSTRACT

This invention puts forward a sectional modular large-deformation-resistant impact-resistant composite rock bolt and its assembling method. The outer anchor module of this composite rock bolt consists of the outer anchor end, anchor tubes and anchor piers, all of which are bonded with the borehole wall through the anchorage agent to act as a full-grouted bolt. And the inner anchor module consists of the outer anchor end, anchor piers, springs and threaded rod. The threaded rod, under the traction by the outer anchor end, presses the inner anchor springs to distribute the anchoring force to the anchor piers, which then pass such force as a pressure to the anchoring agent, thus playing the role of a pressure-dispersive anchor. Before the failure of the anchor tube, the inner anchor module is in parallel with the outer anchor module, playing the role of auxiliary anchorage on surrounding rock; after the failure of the anchor tube, such structure can yield and buffer effectively against the surrounding rock and realize secondary high-strength support timely.

5 Claims, 5 Drawing Sheets

A B

SECTIONAL MODULAR LARGE-DEFORMATION-RESISTANT IMPACT-RESISTANT COMPOSITE ROCK BOLT AND ITS ASSEMBLING METHOD

CROSS REFERENCE TO RELATED APPLICATION

This application is a national stage application of a PCT application PCT/CN2016/084918, Jun. 6, 2016, entitled "A Sectional Modular Large-Deformation-Resistant Impact-Resistant Composite Rock Bolt and Its Assembling Method," which further takes priority from a Chinese application CN 2016102866972, filed May 3, 2016. The international application and Chinese priority application are incorporated herein by reference in their entireties.

TECHNICAL FIELD

This invention involves the technical field of supporting in geotechnical engineering, especially the supporting technology for large-deformation or impact-prone rock mass engineering under high stresses.

BACKGROUND TECHNOLOGY

Rock bolting is an important means for the stability control of geotechnical projects such as mines, tunnels and side slopes. In the research and application of rock bolting, scientists and technicians have developed numerous types of rock bolts and successfully solved a lot of problems in support engineering. However, most of existing rock bolts can hardly adapt to rock mass engineering which features high stress, large deformation and impact proneness. According to the characteristics of stress and deformation of such rock mass engineering, an effective form of rock bolt should have high strength and reasonable yielding property. The basic requirements on such kind of rock bolt are to provide adequate deformation capacity to adapt to large deformation of surrounding rock and meanwhile to provide a relatively high anchoring force continuously in the process of deformation. Currently, main rock bolts of such kind commonly in use include the extensible constant-resistance rock bolt and the rock bolt with yieldable tube at its outer anchor end.

The extensible constant-resistance rock bolt consists of the constant-resistance device, rod body, anchor plate and nut. Among the components, the constant-resistance device comprises the constant-resistance casing tube and constant-resistance body. The inner surface of the constant-resistance casing tube and the outer surface of the rod body adopt the threaded structure. The constant-resistance device is set on the tail part of the rod body, with the anchor plate and nut installed orderly on the tail part of the constant-resistance device. When an axial force applied on the rock bolt reaches its designed constant resistance, the constant-resistance body will slide with friction along the inner wall of the casing tube, and the constant-resistance property will remain unchanged during such slide. Such rock bolt can provide relatively good yielding and anti-impact effect under certain conditions, but it requires bonding at the anchor rod head and the constant-resistance casing tube separately, thus bringing about much difficulty to rock bolt installation; and once the bonding section breaks or loses, the entire rock bolt will fail. Therefore, such rock bolt is defective with difficult installation and low reliability.

The rock bolt with yieldable tube comprises the high-strength rod body, yieldable tube, anchor plate and nut. Compared with ordinary rock bolts, this rock bolt has an additional yieldable tube at its outer anchor end to realize the function of yielding under certain pressure. Depending on different conditions of surrounding rock, the yieldable tube can be designed and manufactured in different sizes. This kind of rock bolts is good in impact resistance. However, on one hand, its yieldable tube is located at the outer anchor end so the length of the yieldable tube that determines the maximum yielding deformation is greatly restricted; on the other hand, it cannot adopt the mode of full-length anchorage in order to give play to the yielding effect, so the entire rock bolt will fail once the bond anchorage section breaks or loses. Therefore, such rock bolt is problematic in its restricted yielding deformation and low reliability.

In summary, all existing types of rock bolts will encounter problems when applied in large-deformation and/or impact-prone rock mass engineering under high stresses, so it is necessary to research and develop a kind of rock bolt which is better in adaptability and reliability.

SUMMARY OF THE INVENTION

To solve the difficulty of support in large-deformation and/or impact-prone rock mass engineering under high stresses, this invention sets forth a sectional modular large-deformation-resistant impact-resistant composite rock bolt as well as its assembling method.

The technical scheme adopted by this invention is: a sectional modular large-deformation-resistant impact-resistant composite rock bolt, which comprises the outer anchor module and inner anchor module;

The said outer anchor module comprises a set of anchor tubes, anchor piers between the anchor tubes, and an outer anchor end. The set of anchor tubes include a head anchor tube, several central anchor tubes and a tail anchor tube. Each of the said anchor piers is connected through threads with anchor tubes at the two ends, and the part between two adjacent anchor piers is an anchoring section. The said outer anchor end includes an anchor plate, preloading spring, anchor ring and nut; the said anchor ring is connected through threads with the tail anchor tube, and the preloading spring is set on the thin part of the anchor ring and tightly pressed against the outer surface of the anchor plate. Under the pressure of the preloading spring, the inner surface of the anchor plate is pressed tightly against the surface of the surrounding rock. The outer end surface of the anchor ring is pressed tightly against the nut;

Located inside the enclosed space formed by the outer anchor module, the said inner anchor module includes the threaded rod, anchor piers, inner anchor springs and baffle rings. The said anchor piers and inner anchor springs are set on the threaded rod. One end of the inner anchor spring is set in the spring groove on the edge of the center hole of the anchor pier, and the other end of the spring is retained on the threaded rod by the said baffle ring. The baffle ring and the threaded rod are connected through threads. There is a locking rubber ring set at one end of each said baffle ring and nut, respectively, to prevent them from moving in the direction of spring extension.

The said outer anchor module and inner anchor module are combined into a whole through the anchor piers and outer anchor end.

As a selective preference, depending on the length requirement of rock bolt, the said threaded rod can be a single piece or an assembly formed by connecting several threaded rods with casing tubes.

As a selective preference, all threaded parts of the said composite rock bolt adopt the right-hand thread except for the external thread of the anchor pier, which is left-hand threaded.

As a selective preference, the diameter of the central circular hole of the said anchor pier is identical to the internal diameter of the inner anchor spring, both of which are slightly larger than the major diameter of the threaded rod; the inner diameter of the anchor tube is slightly larger than the external diameter of the baffle ring; the diameter of the central hole of the anchor plate is slightly larger than the external diameter of the anchor tube, and the internal diameter of the preloading spring is slightly larger than the external diameter of the thin part of the anchor ring.

The outer anchor module of this invention is formed by connecting multiple anchor tubes and multiple anchor piers through threads, and the inner anchor module is formed by connecting multiple springs and multiple baffle rings in series on the threaded rod. The inner anchor module is located inside the enclosed space formed by the outer anchor module. And the inner and outer anchor modules are combined through the anchor piers and outer anchor end into an organic whole. Through selecting structural parts of different quantities and specifications (sizes and mechanical properties), rock bolts with various lengths and anchorage properties (strength, rigidity and deformability) can be assembled to meet the requirements of support for various engineering conditions. There is a locking rubber ring set at one end of each baffle ring and nut, so that the baffle ring or nut can only move in one direction rather than getting loose in the opposite direction. Pushed by the anchor ring, the preloading spring presses the anchor plate tightly against the surface of surrounding rock, to provide a quantitative pretension for the rock bolt. The part between two adjacent anchor piers is an anchorage section. The damage of one anchorage section will not cause the failure of the entire rock bolt. When the anchor tube of an anchorage section breaks, and fails, the internal threaded rod will undertake the role of anchorage. In this case, the multiple inner anchor springs connected to the threaded rod can, on one hand, play the role of buffering to avoid break-off of the threaded rod and, on the other hand, distribute the load on the threaded rod to multiple anchor piers at the two sides of the breakpoint of the anchor tube to prevent any individual anchor pier from being damaged under excessive concentrated stress.

The method for assembling the aforementioned sectional modular large-deformation-resistant impact-resistant composite rock bolt includes the following steps:

Step I: The assembly of the said composite rock bolt is implemented from the central part of the threaded rod to the two ends orderly. Firstly, assemble the anchor piers, inner anchor springs, baffle rings, and locking rubber rings orderly in the central part of the threaded rod;

Step II: Secondly, assemble the central anchor tubes at the two ends of each central anchor piers, and then assemble the anchor piers, inner anchor springs, baffle rings and locking rubber rings orderly at the two ends;

Step III: Then assemble the head anchor tube and tail anchor tube, and finally assemble orderly the anchor plate, preloading spring, anchor ring, nut and locking rubber ring at the outer anchor end.

This invention is beneficial in the following aspects:

(1) Sectional anchorage, with reliable anchorage performance. The part between two adjacent anchor piers is an anchorage section. The damage of one anchorage section will not cause the failure of the entire rock bolt. When the anchor tube of an anchorage section breaks and fails, the internal threaded rod will undertake the role of anchorage. In this case, the multiple inner anchor springs connected to the threaded rod can, on one hand, play the role of buffering to avoid break-off of the threaded rod and, on the other hand, distribute the load on the threaded rod to multiple anchor piers at the two sides of the breakpoint of the anchor tube to prevent any individual anchor pier from being damaged under excessive concentrated stress.

(2) Modular structure, easy to assemble and strong in adaptability. Each rock bolt is divided into the outer anchor module and inner anchor module. The outer anchor module is formed by connecting multiple anchor tubes and multiple anchor piers together through threads; and the inner anchor module consists of multiple springs and multiple baffle rings connected in series on the threaded rod. The inner and outer anchor modules are combined through the anchor piers and outer anchor end into an organic whole. It is easy to connect the structural parts and convenient to assemble the anchor. Through selecting structural parts of different quantities and specifications (sizes and mechanical properties), rock bolts with various lengths and anchorage properties (strength, rigidity and deformability) can be assembled to meet the requirements of support for various engineering conditions.

(3) Multi-stage load bearing, with high anchorage strength, impact-resistance and adaptability to deformation. This invention makes the high-strength anchor tubes, inner anchor springs and high-strength threaded rod play the leading role in load bearing orderly at different work stages, allowing each anchorage section between every two adjacent anchor piers to perform the three-stage load-bearing characteristics of "resistance-yielding-resistance," i.e. primary high-strength anchoring, elastic buffering, and secondary high-strength anchoring. Moreover, in the process of yielding against impact, all the anchorage sections and the preloading spring at the outer anchor end act simultaneously. Therefore, this invention can adapt well to the support of large-deformation and/or impact-prone rocks under high stresses.

(4) The inner anchor module, located inside the enclosed space of the outer module, features strong anti-corrosion capacity and long service life. It is also easy to carry out long-term monitoring of the status of the rock bolt and engineering safety. It is very easy to seal up the outer anchor module of the rock bolt so that the inner anchor springs, threaded rod and other structural parts stay in the enclosed space of the outer anchor module before the failure of the anchor tube, thus effectively avoiding corrosion and damage. This, plus the anti-corrosion treatment of the structural parts, can greatly prolong the service length of the rock bolt. Furthermore, the sensors deployed inside the anchor tube can be free from external interference and premature failure, realizing long-term monitoring of the status of the rock bolt and engineering safety.

(5) It is simple and fast to install the rock bolt, and the pretension can be applied in an easy, accurate and reliable manner. The installation of this invention is as simple and fast as that of the ordinary full-grouted rock bolt. The difference lies in that the pretension of this invention can be applied accurately through turning the anchor ring and nut to make the preloading spring produce a certain amount of compression. This mechanism overcomes the defect of the ordinary rock bolt which can easily encounter the problem of very easy decay of preload, thus providing a relatively high reliability.

SPECIFIC IMPLEMENTATION

Figure 1:
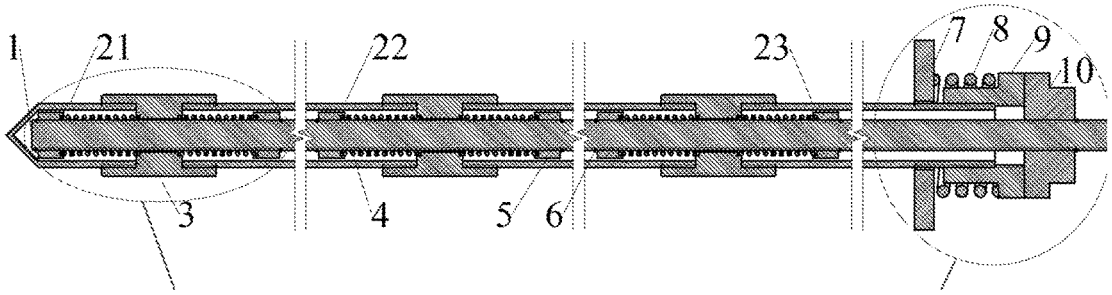
FIG. 1 is the structural schematic diagram of the composite rock bolt set forth by this invention.
Figure 2:
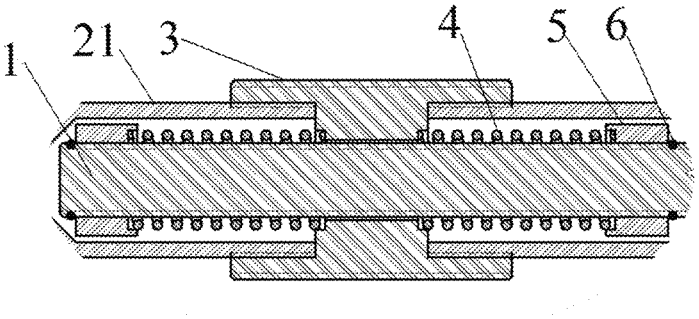
FIG. 2 is the enlarged view of Point A in FIG. 1.
Figure 3:
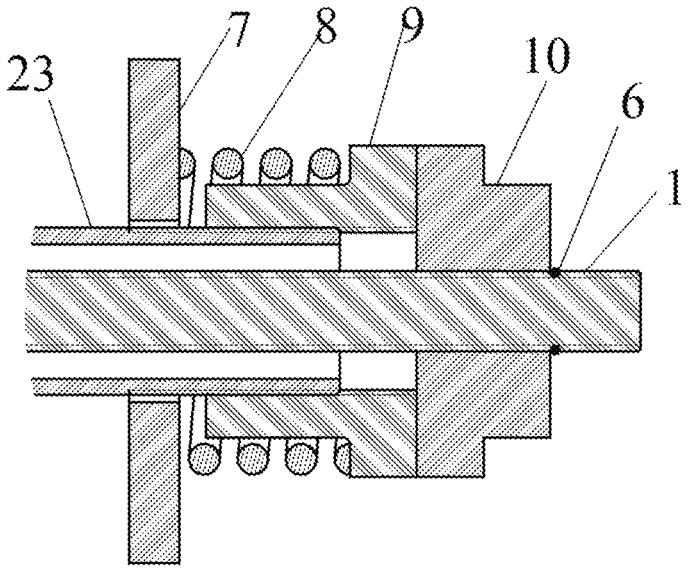
FIG. 3 is the enlarged view of Point B in FIG. 1.
Figure 4:
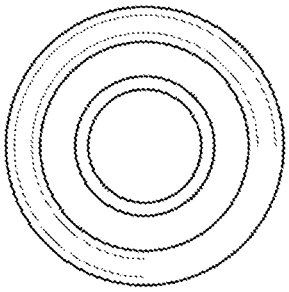
FIG. 4 is the structural schematic diagram of the anchor pier of the composite rock bolt set forth by this invention.
Figure 5:
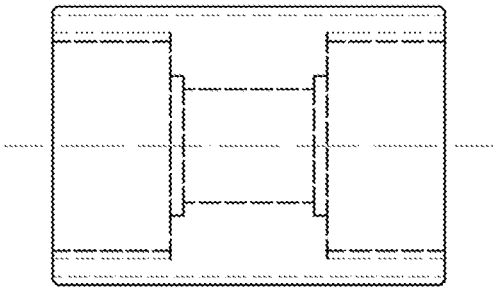
FIG. 5 is the side view of FIG. 4.
Figure 6:
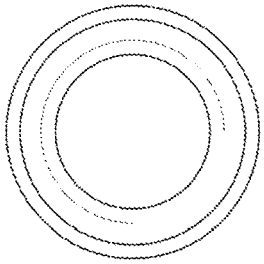
FIG. 6 is the structural schematic diagram of the baffle ring of the composite rock bolt set forth by this invention.
Figure 7:
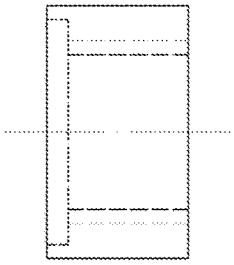
FIG. 7 is the side view of FIG. 6.
Figure 8:
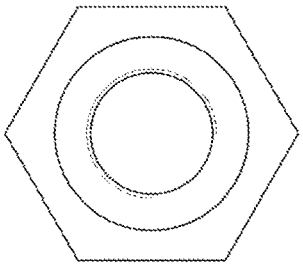
FIG. 8 is the structural schematic diagram of the anchor ring of the composite rock bolt set forth by this invention.
Figure 9:
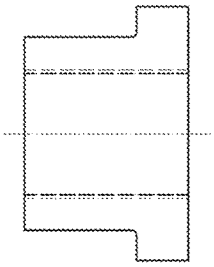
FIG. 9 is the side view of FIG. 8.
Figure 10:
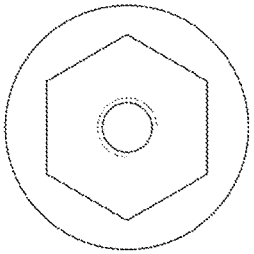
FIG. 10 is the structural schematic diagram of the nut of the composite rock bolt set forth by this invention.
Figure 11:
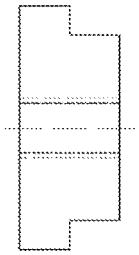
FIG. 11 is the side view of FIG. 10.

A further description of this invention is provided below in combination with the drawings and specific implementation means.

FIGS. 1-11 show a sectional modular large-deformation-resistant impact-resistant composite rock bolt, which consists of the outer anchor module and inner anchor module. The said outer anchor module comprises a set of anchor tubes, anchor piers (3) between the tubes, and outer anchor end. The set of anchor tubes include a head anchor tube (21), several central anchor tubes (22) and a tail anchor tube (23). The said anchor pier (3) is connected through threads to anchor tubes at both ends. The part between every two adjacent anchor piers (3) is an anchorage section. The said outer anchor end comprises the anchor plate (7), preloading spring (8), anchor ring (9) and nut (10). The said anchor ring (9) and the tail anchor tube (23) are connected through threads. The preloading spring (8) is set on the thin part of the anchor ring (9). The preloading spring (8) presses tightly against the outer surface of the anchor plate (7). The inner surface of the anchor plate (7), pushed by the preloading spring (8), is tightly pressed against the surface of surrounding rock. And the outer end surface of the anchor ring (9) clings tightly to the nut (10). The said inner anchor module is located inside the enclosed space formed by the outer anchor module. The inner anchor module comprises the threaded rod (1), anchor piers (3), inner anchor springs (4) and baffle rings (5). The said anchor piers (3) and inner anchor springs (4) are set on the threaded rod (1). One end of the inner anchor spring is positioned in the spring groove on the edge of the central hole of the anchor pier (3); and the other end is restricted by the baffle ring (5) to a certain range of length. The baffle ring (5) and threaded rod (1) are connected through threads. There is a locking rubber ring (6) set on one end of the said baffle ring (5) and nut (10), respectively, to prevent them from moving in the direction of spring extension. The said outer anchor module and inner anchor module are combined through the anchor piers and outer anchor end into a whole.

Depending on the length requirement of rock bolt, the said threaded rod (1) can be a single piece or an assembly formed by connecting several threaded rods with casing tubes. All threaded parts of the said composite rock bolt adopt the right-hand thread except for the external thread of the anchor pier (3), which is left-hand threaded. The diameter of the central circular hole of the said anchor pier (3) is identical to the internal diameter of the inner anchor spring (4), both of which are slightly larger than the major diameter of the threaded rod (1); the inner diameter of the anchor tube is slightly larger than the external diameter of the baffle ring (5); the diameter of the central hole of the anchor plate (7) is slightly larger than the external diameter of the anchor tube; and the internal diameter of the preloading spring (8) is slightly larger than the external diameter of the thin part of the anchor ring (9).

The method for assembling the aforementioned sectional modular large-deformation-resistant impact-resistant composite rock bolt includes the following steps.

Figure 12:
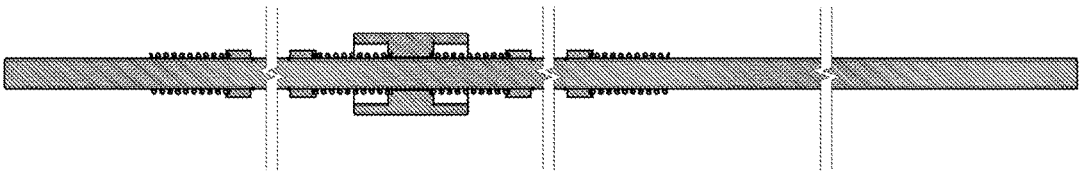
FIG. 12 is the schematic diagram of assembly step 1 of this invention.
Figure 13:
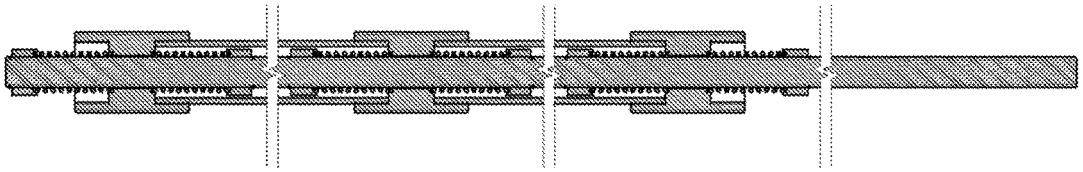
FIG. 13 is the schematic diagram of assembly step 2 of this invention.
Figure 14:
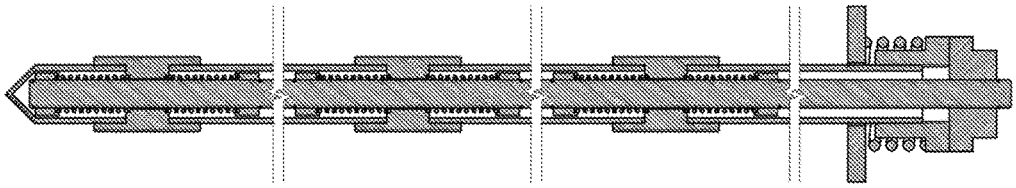
FIG. 14 is the schematic diagram of assembly step 3 of this invention.

As shown in FIG. 12, Step I: The assembly of the said composite rock bolt is implemented from the central part of the threaded rod to the two ends orderly. Firstly, assemble the anchor piers, inner anchor springs, baffle rings, and locking rubber rings orderly in the central part of the threaded rod;

As shown in FIG. 13, Step II: Secondly, assemble the central anchor tubes at the two ends of each central anchor piers, and then assemble the anchor piers, inner anchor springs, baffle rings and locking rubber rings orderly at the two ends;

As shown in FIG. 14, Step III: Then assemble the head anchor tube and tail anchor tube, and finally assemble orderly the anchor plate, preloading spring, anchor ring, nut and locking rubber ring at the outer anchor end.

The working principle and process of this invention is the following.

This invention is an organic combination of the sectional modular full-grouted tubular rock bolt (the outer anchor module) and the impact-resistant pressure-dispersive rock bolt (the inner anchor module). The basic principle of this invention is described as follows: the part between every two adjacent anchor piers is an anchorage section; the outer anchor module consists of the outer anchor end, anchor tubes and anchor piers, all of which are bonded with the borehole wall through the anchorage agent to act as a full-grouted bolt; the inner anchor module consists of the outer anchor end, anchor piers, springs and threaded rod. The threaded rod, under the traction by the outer anchor end, presses the inner anchor springs to distribute the anchoring force to the anchor piers, which then pass such force as a pressure to the anchoring agent, thus playing the role of a pressure-dispersive anchor; before the failure of the anchor tube, the inner anchor module is in parallel with the outer anchor module, playing the role of auxiliary anchorage on surrounding rock; after the failure of the anchor tube, such structure can play the role of buffering and yielding against the surrounding rock and realize secondary high-strength support in a timely manner. In each anchorage section, the high-strength anchor tube, inner anchor spring and high-strength threaded rod play the leading role in load bearing orderly at different work stages, allowing each anchorage section to perform the three-stage load-bearing characteristics of "resistance-yielding-resistance," i.e. primary high-strength anchoring, elastic buffering, and secondary high-strength anchoring. All anchorage sections are relatively independent but connected closely each other, realizing the long-term effective maintenance of surrounding rock while ensuring the reliability of the rock bolt itself.

Figure 15:
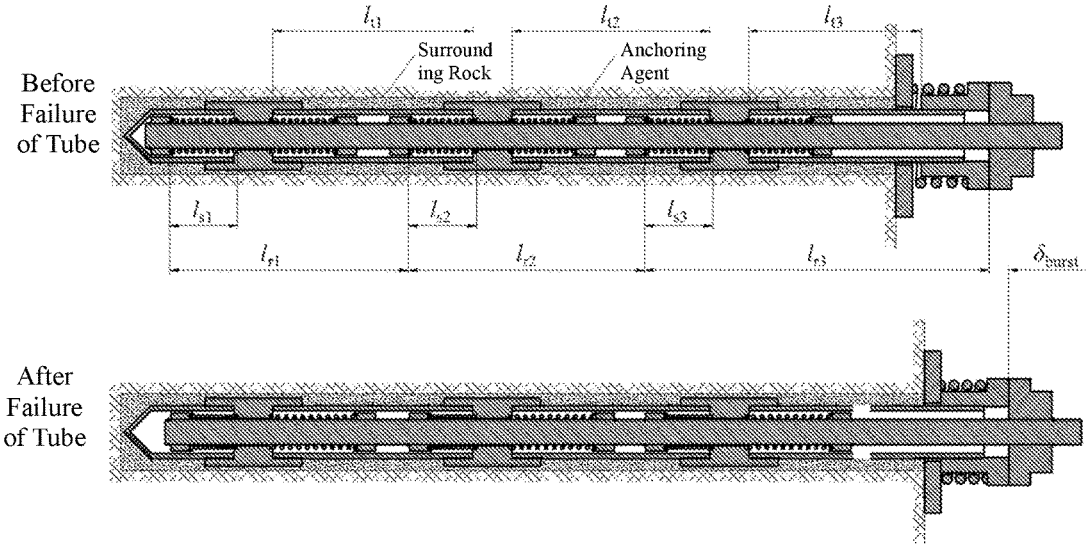
FIG. 15 is the schematic diagrams of the composite rock bolt before and after the failure of an anchor tube.

Take the rock bolt with three anchorage sections as an example. Its working principle and process are shown in FIG. 15. The $l_{t1}$, $l_{t2}$ and $l_{t3}$ in the figure represent the effective lengths of the anchor tubes of the head anchorage section, central anchorage section and tail anchorage section, respectively. The $l_{s1}$, $l_{s2}$ and $l_{s3}$ represent the effective lengths of the springs of the head anchorage section, central anchorage section and tail anchorage section, respectively. The $l_{r1}$, $l_{r2}$ and $l_{r3}$ represent the effective lengths of the rods of the head anchorage section, central anchorage section and tail anchorage section, respectively. And the $\delta_{burst}$ represents the amount of extension suddenly occurring after the failure of the tail anchor tube.

Given that the coefficients of elasticity of the inner anchor springs are $k_r$, $k_2$ and $k_3$, respectively, that the compressive deformation amounts are $\Delta l_{s1}$, $\Delta l_{s2}$ and $\Delta l_{s3}$, respectively, and that the acting forces on the anchor piers are $F_{s1}$, $F_{s2}$ and $F_{s3}$, respectively, it can be determined according to the Hooke's law that the formulas for calculating the acting forces on the anchor piers are as follows:

$$F_{s1}=k_1\cdot\Delta l_{s1} \tag{1}$$

$$F_{s2}=k_2\cdot\Delta l_{s2} \tag{2}$$

$$F_{s3}=k_3\cdot\Delta l_{s3} \tag{3}$$

Given that the modulus of deformation of the threaded rod is E, that the effective area of the cross section is S, that the deformation amounts of the sections are $\Delta l_{r1}$, $\Delta l_{r2}$ and $\Delta l_{r3}$, respectively, and that the axial forces are $F_{r1}$, $F_{r2}$ and $F_{r3}$, respectively, the formulas for calculating the axial forces of the sections of the threaded rod are:

$$F_{r1}=E\cdot S\cdot\Delta l_{r1}/l_{r1} \tag{4}$$

$$F_{r2}=E\cdot S\cdot\Delta l_{r2}/l_{r2} \tag{5}$$

$$F_{r3}=E\cdot S\cdot\Delta l_{r3}/l_{r3} \tag{6}$$

According to the force balance relationship, the relations between the acting forces applied by the spring on the anchor piers and the axial forces of the threaded rod are indicated below:

$$F_{r1}=F_{s1} \tag{7}$$

$$F_{r2}=F_{r1}+F_{s2} \tag{8}$$

$$F_{r3}=F_{r2}+F_{s3} \tag{9}$$

According to formulas (1), (4) and (7), it can be determined that $k_1\cdot\Delta l_{s1}=E\cdot S\cdot\Delta l_{r1}/l_{r1}$. In order to make the spring play an effective role of buffering and yielding before reaching its compression limit so as to avoid the premature breakage of the threaded rod, it is required to make the threaded rod's deformation amount $\Delta l_{r1}$ significantly less than the spring's compression amount $\Delta l_{s1}$, i.e. the threaded rod's rigidity $E\cdot S/l_{r1}$ shall be significantly higher than the inner anchor spring's rigidity $k_1$.

The first stage load bearing of the rock bolt, called the primary high-strength anchoring, takes place from the installation of the rock bolt until the failure of the anchor tube, during which the anchorage property of the entire rock bolt depends mainly on the bonding characteristics of the anchor tube. In this stage, the anchorage on surrounding rock is mainly realized through the high-strength anchor tubes of the outer anchor module acting as a full-grouted rock bolt, and meanwhile the inner anchor module, acting as a pressure-dispersive rock bolt, plays the role of auxiliary support on surrounding rock.

Given that the extension amounts of the anchor tubes induced by the deformation of surrounding rock are $\Delta l_{t1}$, $\Delta l_{t2}$ and $\Delta l_{t3}$, respectively, that the anchor pier of the head anchorage section is the fixed reference point, and that other anchor piers move toward the outside of the drill hole as the anchor tubes extend, it can be determined according to the deformation coordination relations between the structural parts that the following relational expressions exist among the deformation amounts of the anchor tubes, inner anchor springs and threaded rod:

$$\Delta l_{t1}+\Delta l_{t2}+\Delta l_{t3}=\Delta l_{r1}+\Delta l_{r2}+\Delta l_{r3}+\Delta l_{s1} \tag{10}$$

$$\Delta l_{s2}=\Delta l_{s1}+\Delta l_{r1}-\Delta l_{t1} \tag{11}$$

$$\Delta l_{s3}=\Delta l_{s1}+\Delta l_{r1}+\Delta l_{r2}-\Delta l_{t1}-\Delta l_{t2} \tag{12}$$

According to the above formulas and actually measured deformation amounts of the structural parts, the value and distribution of the anchoring force of the inner anchor module can be obtained. Accordingly, the parameters of the structural parts of the rock bolt can be optimized in design to ensure that the rock bolt has the optimal structural stability and support effectiveness under various specific engineering conditions.

The second stage load bearing of the rock bolt, called the buffering and yielding, takes place from the failure of the anchor tube until the inner anchor spring reaching its compression limit. In this stage, the anchorage property of the anchorage section of the failed anchor tube depends on the spring's bearing behavior, while other anchorage sections still work as a grouted rock bolt. When an anchor tube breaks, the status of load bearing in this section will be changed from jointly undertaken by both the outer anchor module and inner anchor module to solely undertaken by the inner anchor module, which will result in a sudden drop of the anchoring force and thus cause the sudden movement $\delta_{burst}$ of surrounding rock between the two sides of the breakage point. As the rigidity of the inner anchor spring is far less than that of the threaded rod, the spring will produce a relatively large compression deformation to absorb most energy released by surrounding rock, and meanwhile the anchoring force applied by the spring via the anchor pier on surrounding rock will increase sharply, thus playing the role of buffering, yielding and timely secondary reinforced support. In addition, the preloading spring at the outer anchor end, pushed by the surrounding rock and anchor plate, will produce a certain amount of compression deformation, which also absorbs partial energy of impact deformation and plays the role of auxiliary buffering and yielding.

Given that in such process the compression amounts of the inner anchor springs are $\Delta l'_{s1}$, $\Delta l'_{s2}$ and $\Delta l'_{s3}$, respectively, and that the deformation amounts of the threaded rod at different sections are $\Delta l'_{r1}$, $\Delta l'_{r2}$ and $\Delta l'_{r3}$, respectively, the following relational expressions can be obtained according to the deformation coordination relations between the structural parts:

$$\Delta l'_{r1}+\Delta l'_{r2}+\Delta l'_{r3}+\Delta l'_{s1}=\delta_{burst} \tag{13}$$

$$\Delta l'_{s2}=\Delta l'_{s1}+\Delta l'_{r1} \tag{14}$$

$$\Delta l'_{s3}=\Delta l'_{s2}+\Delta l'_{r2} \tag{15}$$

It can be seen that the spring compression amounts newly added during the buffering period show the relation of $\Delta l'_{s1}<\Delta l'_{s2}<\Delta l'_{s3}$, i.e. the closer to the breakage point an inner anchor spring is, the larger compression amount it will produce.

The third stage load bearing of the rock bolt, called the secondary high-strength anchoring, starts from the inner anchor spring having reached its compression limit. The anchorage property of the anchorage section of the failed anchor tube in this stage depends on the threaded rod's bearing behavior, while other anchorage sections still work mainly as a grouted rock bolt. When the inner anchor spring has reached its compression limit, its acting force on the anchor pier will no longer be influenced by the spring's mechanical parameters but depend on the threaded rod's stress-strain relationship and deformation of each anchorage section. After the first stage of primary high-strength anchoring and the second stage of buffering and yielding, the threaded rods at all anchorage sections usually have undergone relatively large deformation and consequently remain in a state of high stress, thus being able to provide timely secondary high-strength support on surrounding rock.

It should be pointed out that as far as general technicians in this technical field are concerned, they may implement some improvements and modifications on the premise of following the principle of this invention, however, such improvements and modifications shall be deemed as within the coverage of protection of this invention. All components unspecified herein can be realized through existing technology.

The invention claimed is:

1. A sectional modular large-deformation-resistant impact-resistant composite rock bolt, wherein the composite rock bolt is divided into an outer anchor module and an inner anchor module; wherein said outer anchor module comprises a set of anchor tubes, anchor piers between the anchor tubes, and an outer anchor end, wherein the set of anchor tubes include a head anchor tube, several central anchor tubes and a tail anchor tube;

each of said anchor piers is connected with the anchor tubes at two ends through threads, and an assembly between two adjacent anchor piers is called an anchorage section;

said outer anchor end includes an anchor plate, a preloading spring, an anchor ring and a nut; wherein said anchor ring is connected with the tail anchor tube through threads;

the preloading spring is disposed on a shaft portion of the anchor ring having a smaller diameter than a head portion of the anchor ring and secured against an outer surface of the anchor plate;

under pressure of the preloading spring, an inner surface of the anchor plate is pressed tightly against a surface of a surrounding rock and an outer end surface of the anchor ring is secured against the nut;

said inner anchor module, located inside enclosed space formed by the outer anchor module, includes a threaded rod, anchor piers, inner anchor springs and baffle rings, wherein said anchor piers and inner anchor springs are disposed the threaded rod;

one end of the inner anchor spring is set in a spring groove on an edge of a center hole of the anchor piers, and the other end of the inner anchor spring is retained on the threaded rod by said baffle rings, the baffle rings and the threaded rod are connected through threads; a locking rubber ring is set at one end of each said baffle ring and nut, respectively, to prevent them from moving in the direction of spring extension;

said outer anchor module and inner anchor module are connected through the outer anchor end.

2. The sectional modular large-deformation-resistant impact-resistant composite rock bolt according to claim 1 wherein said threaded rod is either a single piece or an assembly formed by connecting several threaded rods via casing tubes.

3. The sectional modular large-deformation-resistant impact-resistant composite rock bolt according to claim 1 wherein all threaded parts of said composite rock bolt are right-hand threaded except for the external thread of the anchor piers.

4. The sectional modular large-deformation-resistant impact-resistant composite rock bolt according to claim 1 wherein a diameter of a central circular hole of the anchor pier shoulder is identical to internal diameter of the inner anchor spring, both of which are slightly larger than the major diameter of the threaded rod, that the inner diameter of the anchor tube is slightly larger than the external diameter of the baffle ring, that the diameter of the central hole of the anchor plate is slightly larger than the external diameter of the anchor tube, and that the internal diameter of the preloading spring is slightly larger than the external diameter of the shaft portion of the anchor ring.

5. A method for assembling the sectional modular large-deformation-resistant impact-resistant composite rock bolt according to claim 1 including the following steps:

Step I: implementing said composite rock bolt from a central part of the threaded rod to the two ends orderly by assembling the anchor piers, inner anchor springs, baffle rings, and locking rubber rings orderly in the central part of the threaded rod;

Step II: assembling central anchor tubes at the two ends of each central anchor pier, and then assembling the anchor piers, inner anchor springs, baffle rings and locking rubber rings orderly at the two ends;

Step III: assembling the head anchor tube and tail anchor tube, and assembling the anchor plate, preloading spring, anchor ring, nut and locking rubber ring at the outer anchor end, in that order.

* * * * *